US011339639B2

(12) United States Patent
Johnsen et al.

(10) Patent No.: US 11,339,639 B2
(45) Date of Patent: May 24, 2022

(54) SYSTEM AND METHOD FOR OFFSHORE HYDROCARBON PROCESSING

(71) Applicant: Equinor Energy AS, Stavanger (NO)

(72) Inventors: Cecilie Gotaas Johnsen, Trondheim (NO); Arild Samuelsberg, Haugesund (NO)

(73) Assignee: Equinor Energy AS, Stavanger (NO)

( * ) Notice: Subject to any disclaimer, the term of this patent is extended or adjusted under 35 U.S.C. 154(b) by 0 days.

(21) Appl. No.: 17/050,272

(22) PCT Filed: Apr. 24, 2019

(86) PCT No.: PCT/NO2019/050092

§ 371 (c)(1),
(2) Date: Oct. 23, 2020

(87) PCT Pub. No.: WO2019/209118

PCT Pub. Date: Oct. 31, 2019

(65) Prior Publication Data

US 2021/0079777 A1 Mar. 18, 2021

(30) Foreign Application Priority Data

Apr. 24, 2018 (NO) ..... 20180573

(51) Int. Cl.
*E21B 43/017* (2006.01)
*E21B 43/36* (2006.01)
(Continued)

(52) U.S. Cl.
CPC ..... *E21B 43/36* (2013.01); *E21B 43/013* (2013.01); *E21B 43/017* (2013.01); *E21B 43/40* (2013.01)

(58) Field of Classification Search
CPC ..... E21B 43/017; E21B 43/36; E21B 43/40
See application file for complete search history.

(56) References Cited

U.S. PATENT DOCUMENTS 3,504,741 A 4/1970 Baker et al.
3,880,102 A 4/1975 Biewer
(Continued)

FOREIGN PATENT DOCUMENTS

CN 102337868 A 2/2012
CN 106593363 A 4/2017
(Continued)

OTHER PUBLICATIONS

Jul. 3, 2019—(WO) International Search Report and Written Opinion—APP PCT/NO2019/050092.
(Continued)

*Primary Examiner* — Matthew R Buck
(74) *Attorney, Agent, or Firm* — Banner & Witcoff, Ltd.

(57) ABSTRACT

A system for hydrocarbon production comprising a host for receiving produced hydrocarbon; an offshore hydrocarbon production facility comprising: a production wellhead for connection to a subsea hydrocarbon reservoir; a production platform configured to receive produced fluid from the wellhead and being in fluid communication with the host via a long distance pipeline; wherein the wellhead is local to the production platform, and the production platform is configured to process the produced fluid to provide a semi-stable oil product suitable for exporting along the long distance pipeline to the host.

21 Claims, 4 Drawing Sheets

(51) Int. Cl.

| | |
|---|---|
| ***E21B 43/40*** | (2006.01) |
| ***E21B 43/013*** | (2006.01) |

(56) References Cited

U.S. PATENT DOCUMENTS

| | | | | |
|---|---|---|---|---|
| 4,127,003 | A | 11/1978 | Vilain | |
| 5,390,743 | A | 2/1995 | Giannesini | |
| 5,477,924 | A | 12/1995 | Pollack | |
| 5,988,283 | A | 11/1999 | Gann | |
| 6,263,971 | B1 | 7/2001 | Giannesini | |
| 6,672,391 | B2 | 1/2004 | Anderson et al. | |
| 9,458,700 | B2 * | 10/2016 | Wille | E21B 43/40 |
| 2003/0159581 | A1 | 8/2003 | Sanderford et al. | |
| 2003/0188873 | A1 | 10/2003 | Anderson et al. | |
| 2005/0072574 | A1 | 4/2005 | Appleford et al. | |
| 2006/0004593 | A1 * | 1/2006 | Seat | B63B 35/44 705/1.1 |
| 2010/0048963 | A1 | 2/2010 | Jones et al. | |
| 2013/0008663 | A1 * | 1/2013 | Maclean | F01K 13/00 166/357 |
| 2018/0030823 | A1 | 2/2018 | Nedwed et al. | |
| 2018/0266229 | A1 * | 9/2018 | Fredheim | E21B 43/01 |

FOREIGN PATENT DOCUMENTS

| | | | |
|---|---|---|---|
| GB | 1244273 | A | 8/1971 |
| GB | 2133446 | A | 7/1984 |
| GB | 2255102 | A | 10/1992 |
| GB | 2544715 | A | 5/2017 |
| GB | 2554076 | A | 3/2018 |
| KR | 101507226 | B1 | 3/2015 |
| KR | 20150111495 | A | 10/2015 |
| KR | 20150111497 | A | 10/2015 |
| WO | 9712118 | A1 | 4/1997 |
| WO | 02063135 | A1 | 8/2002 |
| WO | 03086976 | A2 | 10/2003 |
| WO | 17048132 | A1 | 3/2017 |
| WO | 2018139939 | A1 | 8/2018 |

OTHER PUBLICATIONS

Nov. 15, 2018—(WO) Search Report—APP 20180573.
Nov. 15, 2018—(WO) Office Action—APP 20180573.
Mar. 12, 2018—Subject Matter Search Report.
Argento et al., "Remote Deepwater Oil Field Tie-Back: Conventional Or Innovative Solution?", Offshore Technology Conference, Paper OTC-22680-MS, Oct. 4-6, 2011, Rio de Janeiro, Brazil.
Jahn, et al., 2008, Developments in Petroleum Science, pp. 297-302.
Yamamoto et al., "Integrated subsea production system: An overview on energy distribution and remote collrol", Petroleum and Chemical Industry Conference—Brasil (PCIC Brasil), Aug. 25-27, 2014, Rio de Janeiro, Brazil, pp. 173-181.
Zakarian, et al, "Shtokman: the management of flow assurance constraints in remote arctic environment", 24th World Gas Conference, (Oct. 5-9, 2009) Buenos Aires, Argentina.
Jul. 4, 2019—(WO) International Search Report and Written Opinion—Appl. No. PCT/NO2019/050093, 10 pages.
Eurasian Office Action 565902EA of Eurasia National Phase application of PCT Application PCT/NO2019/050093, earliest priority filing date Apr. 24, 2018.

* cited by examiner

SYSTEM AND METHOD FOR OFFSHORE HYDROCARBON PROCESSING

The present application is a U.S. National Phase of International Application No. PCT/N02019/050092, filed on Apr. 24, 2019, designating the United States of America and claiming priority to Norwegian Patent Application No. 20180573, filed on Apr. 24, 2018. This application claims priority to and the benefit of the above-identified applications, which are fully incorporated by reference herein in their entirety.

The present invention concerns a system for hydrocarbon production which is useful in (but not limited to) the exploitation of marginal sub-sea oil reserves, particularly those distributed over large areas of the seabed where it is not viable to implement dedicated manned platforms for each reserve.

Overcoming current economic difficulties in exploiting marginal oil reservoirs is becoming increasingly important as known large reserves are depleted and it becomes more desirable to exploit smaller reserves that are often distributed over wide areas within a given oilfield. In order to make the exploitation of such marginal reservoirs more economically sustainable, it is desirable to exploit as great an area of marginal oil reservoirs as possible with minimum equipment/personnel, outlay and running cost.

One known approach is to connect ("tie-back") a number of remote ("satellite") wells to a single platform in order to exploit multiple reservoirs that are some distance away. However, the fluid produced from a hydrocarbon well is typically a mixture including oil, water and gas. Such a mixture of fluid cannot be easily transported by pipeline, at least over long distances, because the multiple phases make it difficult to pump and because hydrates can form and block the pipeline.

Hydrates are ice-like crystalline solids composed of water and gas, and hydrate deposition on the inside wall of gas and/or oil pipelines is a severe problem in oil and gas production infrastructure. As discussed below with reference to FIG. 4, for a given hydrocarbon fluid, hydrates form at higher pressures and lower temperatures. When warm hydrocarbon fluid containing water flows through a pipeline with cold walls, hydrates will precipitate and adhere to the inner walls. This reduces the pipeline cross-sectional area, which, without proper counter measures, will lead to a loss of pressure and ultimately to a complete blockage of the pipeline or other process equipment. Transportation of gas over distance therefore normally requires hydrate control.

Existing technologies that deal with the problem of hydrate formation over short distances include:

- Mechanical scraping of the deposits from the inner pipe wall at regular intervals by pigging.
- Electric heating and insulation keeping the pipeline warm (above the hydrate formation temperature).
- Addition of inhibitors (thermodynamic or kinetic), which prevent hydrate formation and/or deposition.

Pigging is a complex and expensive operation. It is also not well suited for subsea pipelines because the pig has to be inserted using remotely operated subsea vehicles.

Electric heating is possible subsea if the pipeline is not too long, such as of the order of 1-30 km, but it is not currently viable over longer distances—say 50 to 100 km, or longer. However, even over shorter distances, the installation and operational costs are again high. In addition, hydrate formation will occur during production stops or slowdowns, as the hydrocarbons will cool below the hydrate formation temperature.

The addition of a hydrate inhibitor, such as an alcohol (methanol or ethanol) or a glycol such as monoethylene glycol (MEG or 1,2-ethanediol), is inexpensive and the inhibitor is simple to inject. However, if the water content is high, proportionally larger amounts of inhibitor are needed, which at the receiving end, will require a hydrate inhibitor regeneration process unit with sufficient capacity to recover and recycle the inhibitor.

The above techniques may therefore be utilised for short distance transportation (up to approximately 60 km), for example, from the wellhead to a central processing hub. However, they are not suitable for transportation over long distances.

It is also known in the art to carry out some processing of hydrocarbons produced from wells prior to transportation. However, traditional (typically subsea) processing facilities only minimally process the incoming hydrocarbon-containing stream, which is then transported as a two-phase or multi-phase mixture to a central offshore processing hub located between several oil and gas reservoirs/wellheads; see GB 1244273 for example. Further processing of the hydrocarbons to meet pipeline transportation specifications is then performed utilising the processing capacity of the central offshore processing hub.

Whilst such processing allows a multi-phase mixture of hydrocarbon to be transported over relatively short distances back to a processing hub that carries out further processing, it is not extensive enough for long distance transportation.

One known solution is to provide storage local to the wellheads for separated fluids, such as oil and gas, either on the seabed or on a local surface platform, see GB 2544715 and CN 102337868, for example. However, a vessel, (i.e. a tanker ship) is then required to collect the stored fluids and recover them to a master host or platform. This is obviously inefficient and the vessel itself represents a high outlay of capital.

It is also known in the art to fully stabilise the hydrocarbon fluid produced from a well, by separating its constituents and conditioning them for storage prior to transportation away from the well. Full stabilisation is achieved by decreasing the pressure of the produced fluid to atmospheric pressure and separating the gas and liquid phases that result. (A fully stabilised liquid is one that is in a fully stable liquid phase at atmospheric conditions, i.e. it will not evaporate or precipitate into hydrates at atmospheric pressure and ambient atmospheric temperature.) Such a fully stabilised liquid can then be transported to another location, e.g. onshore, at atmospheric conditions and it will remain stable. However, a substantial amount of processing, and hence processing equipment, is required at the reserve in order to achieve this.

According to a first aspect of the present invention, there is provided a system for hydrocarbon production comprising: a host for receiving produced hydrocarbon; an offshore hydrocarbon production facility comprising: a production wellhead for connection to a subsea hydrocarbon reservoir; a production platform configured to receive produced fluid from the wellhead and being in fluid communication with the host via a long distance pipeline; wherein the wellhead is local to the production platform, and the production platform is configured to process the produced fluid to provide a semi-stable oil product suitable for exporting along the long distance pipeline to the host.

The term "semi-stable" herein is used to describe a liquid that has been stabilised to a certain extent, but has not been fully stabilised. This means that under certain pressure and temperature conditions (in this case the conditions found in a long-distance pipeline) it will remain in a single (liquid)

phase, avoiding evaporation and precipitation (i.e. the precipitation of hydrates in the liquid). However, unlike a fully-stabilised liquid, it must be maintained at a pressure above atmospheric pressure. Accordingly, the oil product is taken outside of the "hydrate envelope" for the conditions under which it will be held whilst being transported to the host.

An oil product is semi-stabilised by processing, and such processing typically involves the degassing of the oil product and/or the separation of water from the oil product to a certain extent. The extent of this processing is dependent on the conditions at which the oil product will be held whilst being transported, such that it is taken outside of the hydrate envelope, as noted above. As the fluid will cool as it passes along a pipeline (due to the cooler water surrounding the pipeline) and as its pressure will reduce with distance (due to friction), it is necessary to consider conditions along the length of the pipeline. A semi-stable oil product typically still comprises some gas fractions from the produced fluid combined with oil fractions and some water from the produced fluid in a single liquid phase, wherein the gas fractions remain entrained in the liquid product under pressurised conditions.

The stability of an oil product is often described by its true vapour pressure (TVP). The true vapour pressure of a fully stabilised product is typically around 0.97 bar, and such an oil product will be stable under atmospheric conditions. Processing of the produced fluid to form a semi-stable oil product may lower the TVP of the oil product to below the TVP of fluid in the reservoir, but it will remain above 1 bar, and more typically above 1.3 bar. Producing such a semi-stable liquid product is advantageous since the amount of processing of the produced fluid in the vicinity of the well (e.g. prior to transportation) is reduced compared to a fully stabilised product.

Thus, the invention is based upon a recognition by the inventors that there is no need to create a fully stabilised oil product prior to transportation of the oil product away from the well, as long as it is stabilised to the extent that it can be transported via long distance pipelines as a single phase and outside the hydrate forming envelope. Producing a semi-stabilised oil product requires fewer processing steps and less equipment than producing a fully stabilised product. Thus, by means of the invention it is possible to transport the produced fluid over very long distances to a host without the need for either a heated pipeline or a local facility able to fully stabilise the produced fluids, either of which are impracticable and commercially unviable in the case of a marginal reserve.

This means that one host can more readily exploit a very large area of seabed by utilising a number of "satellite" processing facilities that are "tied-back" to the host via long distance pipelines. Each host may exploit a number of local wellheads/reservoirs thereby exploiting a greater are of marginal oil reservoirs and increasing the economic sustainability of such operations further.

The higher pressure at which the semi-stabilised oil product is held, compared to a fully-stabilised oil product, may also aid in transporting it along the long distance pipeline without the use of boosters, thereby further reducing the cost and difficulty in setting up the installation.

The produced fluid at the well may typically have a pressure in the range of 100-1000 bar (absolute) and a temperature generally in, but not limited to, the range of 60-130° C. Indeed, the temperature may be as low as 20° C. and as high as 200° C. in HTHP (high-pressure-high-temperature) wells, for example. In addition to hydrocarbons, the produced fluid will often contain liquid water and water in the gas phase corresponding to the water vapour pressure at the current temperature and pressure. As discussed above, if the produced fluid is transported untreated over long distances and allowed to cool, then the water in gas phase will condense and, below the hydrate formation temperature, hydrates will form. The hydrate formation temperature is in the range of 20-30° C. at pressures of between 100-400 bar. Temperature within the long-distance pipeline is typically between 3° C. and 25° C., but may also range between −5° C. and 100° C. Subject to any boosting via pumps that may be provided, the pressure within the pipeline will reduce with distance. However, the pressure must be sufficient to remain above that required at the host. Pressure within the pipeline is typically 10-80 bar, more typically 20-60 bar or 30-40 bar, but may also range up to 300-400 bar. The temperature and pressure are not limited to these conditions, and are dependent on sea temperature, depth, salt content and other metocean data. As noted above, these conditions must be considered when determining the degree of processing to provide the semi-stable oil product. Based on the temperature and pressure conditions along/within the pipeline, the oil product should remain outside the hydrate formation envelope (i.e. below the hydrate curve) throughout the length of the pipeline as it is transported.

In the event of a shutdown (i.e. the cessation of oil production and processing), the temperate may drop to a level that would bring the oil product into the hydrate formation envelope. However, this may be addressed by depressurising the pipeline.

Although the invention may be carried out using a conventional manned production platform, since only limited processing of the produced fluid is required, an unmanned production platform (UPP™) is both suitable and preferred. The use of an UPP™ greatly improves the commercial viability of producing a marginal reserve. The system will typically employ a plurality of such offshore hydrocarbon production facilities (preferably UPP™s), which may be distributed over a very wide area in order to exploit multiple marginal reserves within a given oil field.

Whilst the system may only be used to provide a transportable oil product, preferably the production platform is further configured to process the produced fluid to produce a gas product and/or a water product. Furthermore, the production platform may be configured to re-inject at least part of the gas product and/or at least part of the water product into the subsea oil reservoir.

Additionally or alternatively, the production platform may be configured to generate electrical power by combusting at least part of the gas product. This reduces or eliminates the need for a separate source of power. In a further alternative (which may be used in combination with the first two), the gas may be transported for supply as fuel elsewhere. Thus, the gas may be used for injection, for power generation locally, or for supply as a fuel product.

The production wellhead may be entirely subsea, but alternatively it may be partially or wholly located at the surface, as in a dry wellhead/tree. Such dry wellheads may be provided on a jacket structure in shallow waters (less than 150 m water depth). The production wellhead is preferably arranged to supply produced fluid to the production platform via subsea flow lines, a riser base and a riser. Likewise, it is preferably arranged to supply water from the water product and/or gas from the gas product to injection wellheads on the seabed via a riser, riser base and subsea flow lines. Injection wellheads may be configured to inject the water product, gas product, or both, and may inject into the reservoir from which the produced fluid is removed or into a separate, additional well.

Whilst the host may be relatively nearby, e.g. less than 50 km from the wellhead, the invention is particularly useful where the distance is greater, e.g. at least 50 km, at least 100 km or at least 200 km from the offshore hydrocarbon production facility. The system may be used with any suitable host, which may, when the geography is appropriate, be on-shore. However, it is believed that in most cases it will be most convenient for the host to be offshore and so the host is preferably an offshore platform or vessel.

As noted above, the invention is particularly advantageous because the oil product need only be partially stabilised such that hydrates cannot form in the long distance pipeline to the host at the temperature and pressure therein (the pipeline typically being unheated). The minimum degree of stabilisation required therefore depends on these conditions (which are well understood and can be determined in a given case by the person skilled in the art). Likewise, at least based on the teaching herein, the skilled person would readily be able to provide such a degree of stabilisation. It will be appreciated that the system remains functional at higher degrees of stability, but this would involve greater-than-necessary processing at the remote platform. Thus, the production platform may typically be configured to process the produced fluid to provide an oil product that is sufficiently stable to be transported to a host located at least 50 km or at least 100 km or at least 200 km distant therefrom via an unheated subsea pipeline without significant hydrate formation.

The semi-stable oil product may be stored at the host for later collection by tanker or similar. Alternatively, the semi-stable oil product may be transported via a pipeline to an additional processing facility. In this way, a single host can store or transport the semi-stable oil product from a number of satellite processing facilities local to reservoirs, thereby reducing the storage and transport equipment required.

The host may be configured to further process and stabilise the semi-stable product further and this further processing may form a fully stable oil product. The benefit realised from having a single host to further process the semi-stable oil product is that further processing equipment can be located at the single location of the host. This allows the processing equipment at satellite processing facilities local to the reservoir to be reduced whilst still providing a fully stabilised end oil product.

As previously noted, the processing of the produced fluid will typically involve one or more separation step(s). The skilled person may apply a range of designs of separator, but preferably the production platform comprises a two-stage separation system for producing the semi-stable oil product. In such an arrangement, an oil product outlet may be provided from a second stage of the two-stage separation system, which is connected to the long distance pipeline via a riser and a riser base at the seabed. In addition, there may be a water product outlet from the first stage of the two-stage separation system that is connected to injection wellheads on the seabed.

With regard to the gas product, both stages of the two-stage separation system may have gas outlets leading to a plurality of gas compressors arranged in series, with the final compressor having an outlet for the gas product.

The invention also extends to a corresponding method. Thus, a further aspect of the invention provides a method of hydrocarbon production comprising providing: a host for receiving produced hydrocarbon; and an offshore hydrocarbon production facility, said facility comprising: a production wellhead for connection to a subsea hydrocarbon reservoir; a production platform local to the production platform configured to receive produced fluid from the wellhead and being in fluid communication with the host via a long distance pipeline; wherein the production platform processes the produced fluid to provide asemi-stable oil product and exports it along the long distance pipeline to the host.

Preferably the method comprises providing and using a system according to any of the forms of the system previously described.

Certain embodiments of the present invention will now be described, by way of example only, with reference to the accompanying drawings, in which.

Figure 1:
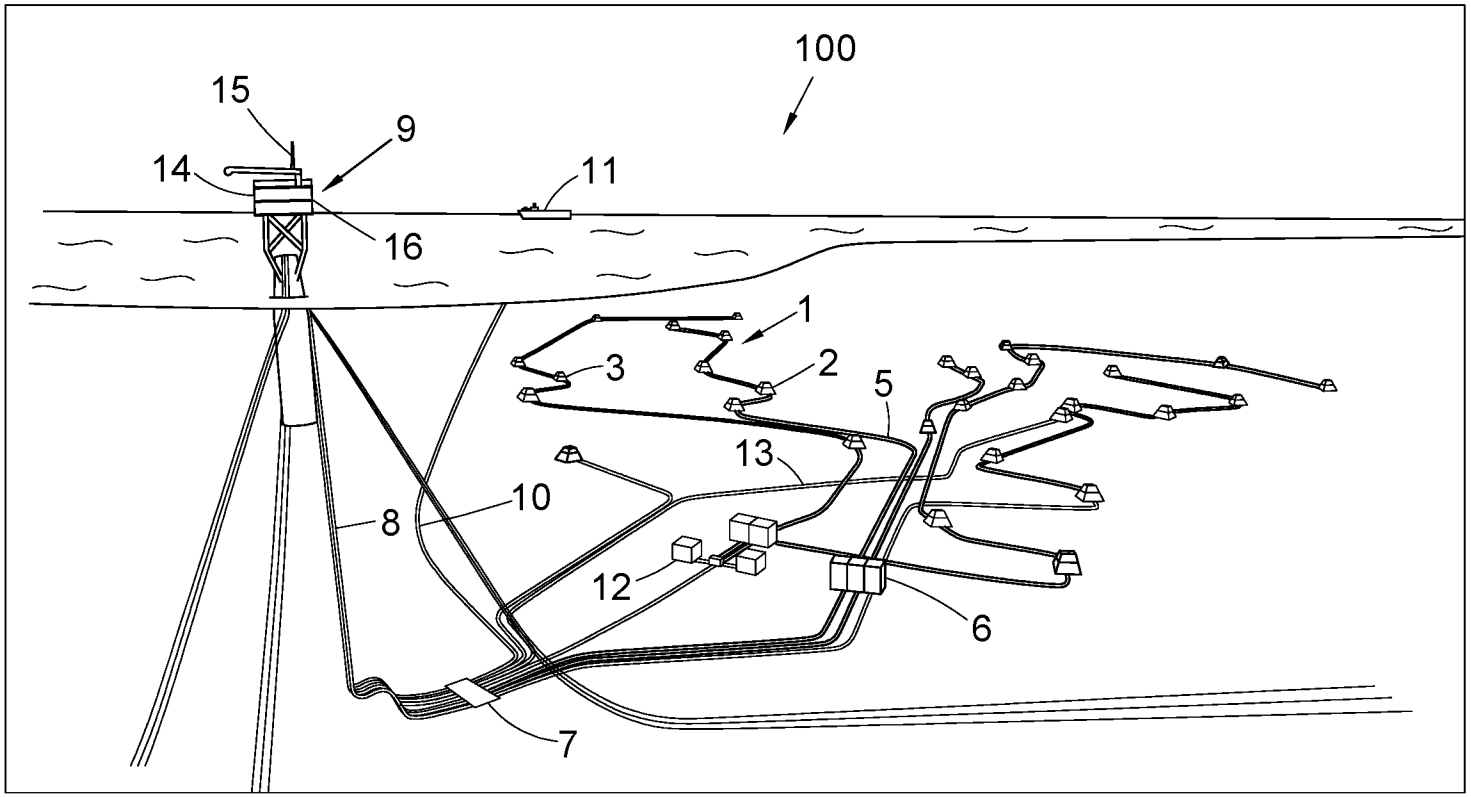
FIG. 1 is a perspective view of a satellite field and host of an embodiment of the present invention.

The illustrated embodiment is a subsea hydrocarbon production system in which a number of satellite fields are connected to a remote host platform or vessel over long distances. The remote fields contain what would traditionally have been regarded as marginal reserves. In FIG. 1 only one such satellite field is shown in the foreground and a remote host in the background, but other satellite fields are provide at other remote locations. As will be described below, the satellite field has a local Unmanned Production Platform (UPP™), which separates hydrocarbon-containing fluid produced from local wellheads, partially stabilises an oil product at a and subsequently transports the oil product via a long distance pipeline to a host for further processing, as will be described below.

Wellheads 1 are shown on the seabed in communication with a subsea hydrocarbon reservoir (not shown). The wellheads comprise producers 2 and injectors 3. The wellheads 1 are connected via flow lines 5, subsea multiphase pumps 6 and riser base 7 to a riser 8, which provides multiple fluid flow conduits to and from UPP™ 9.

Extending away from the riser base 7 along the seabed is long distance pipeline 10, which extends to a remote host 11, in the form of a tanker vessel 11.

Figure 3:
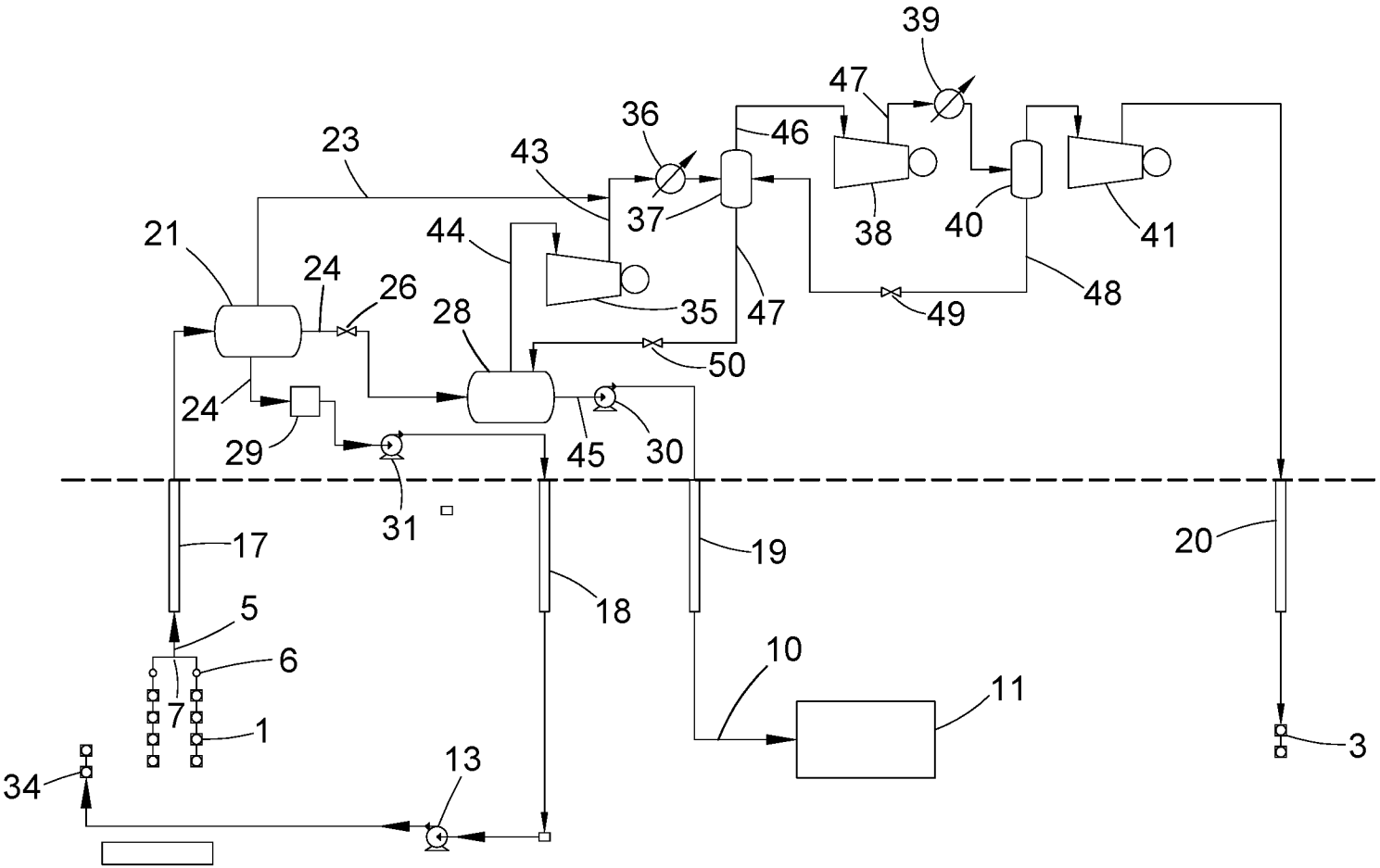
FIG. 3 is a schematic fluid flow diagram showing the separation and processing features of a local Unmanned Production Platform (UPP™), which forms part of the embodiment.

The UPP™ is a floating platform anchored to the seabed. It provides various facilities for treating hydrocarbon-containing fluids (hereinafter also referred to as the produced fluid). These include a separation system 16, which is illustrated in FIG. 3, water treatment system 14, a gas-fueled power production unit 15 and a gas conditioning system.

The produced fluid is a mixture including oil, water, and natural gas. It is produced from the reservoir in the conventional manner at the producers 2. It then passes through flow lines 5 and is boosted through the subsea multiphase pumps 6 to riser base 7. The hydrocarbon-containing fluid is then lifted through a conduit in riser 8 to UPP™ 9.

At the UPP™, the hydrocarbon-containing fluid is separated into constituent parts—oil, gas, water, sediments, etc. by separator 16—as will be discussed in more detail below with reference to FIG. 3. The oil is then transported via riser 8 and riser base 7 to a long distance pipeline 10 on the seabed.

The oil is partly stabilized, through degassing and dewatering processes, such that it is outside of the hydrate forming envelope of the long-distance pipeline 10, whilst also being within the final processing capability of the host 11. This allows the oil to be transported via long-distance pipelines 10 (up to 250 or even 500 km) to the host 11.

Figure 4:
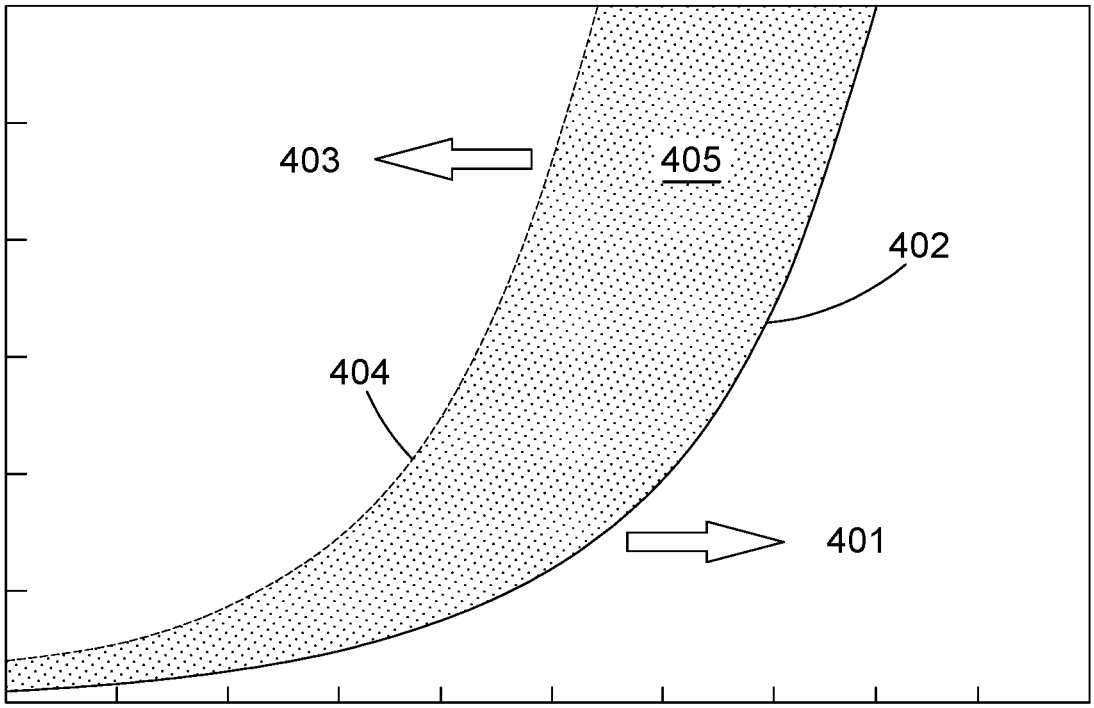
FIG. 4 shows a generic hydrate-formation phase diagram for an oil product.

With reference to FIG. 4, a hydrate formation phase diagram of a typical oil product (which may contain oil, water and gas) can be seen, with the temperature and pressure that the oil product may be held at shown on the X and Y axes respectively. There is a hydrate free region 401 on the right hand side of a hydrate dissociation curve 402, a hydrate stable region 403 (i.e. a region where hydrates have formed and are stable in the fluid) on the left hand side of a hydrate formation curve 404 and a metastable region 405 in between the hydrate formation curve and the hydrate dissociation curve where there is a risk of hydrate formation.

An oil product held at low pressure and high temperature will reduce hydrate formation, whereas high pressures and low temperatures increase hydrate formation.

The degassing and separation of water from the product alters the location of the hydrate formation and dissociation curves. Typically, such processing will move the hydrate formation curve to the left of the figure such that the oil product can be held at higher pressures and lower temperatures without the formation of hydrates.

Typically, the longer the (unheated) long distance pipeline is, the colder the semi-stabilised oil product will become as its temperature approaches that of the seawater surrounding the pipe, thereby increasing the risk of hydrate formation. As a result, a longer pipeline will require an oil product that is processed more (e.g. via degassing and/or water separation) in order to alter the hydrate formation curve and avoid the hydrate formation region.

In these embodiments, the oil product is processed just to the extent that it is taken outside of the hydrate envelope for the conditions of the long distance pipeline so that significant hydrate formation in the pipeline can be avoided (along with avoiding the use of a heated pipeline and/or boosters) in addition to avoiding the use of unnecessary processing equipment at the UPP, thus reducing the cost, size and difficulty in setting up and maintaining these installations.

At the host, further processing of the oil to a fully stabilized product is carried out. It is then stored for subsequent transportation, or transported directly, to a terminal. In a variant of the embodiment, the further processing also conditions the oil so that it meets final specification requirements.

The gas separated from the hydrocarbon-containing fluid is conditioned at the UPP™ 9 so that it may be used for gas injection back into the subsea oil reservoir. After conditioning, the gas passes through a conduit in riser 8, via riser base 7 and flow lines 5 to injectors 3, where it is re-injected into the reservoir. The re-injection of gas is a known process that supports the pressure of the well as fluid is produced and can also cause the pressure to rise in the well, causing more gas molecules to dissolve in the oil, thereby lowering its viscosity and increasing the well's output.

In the illustrated embodiment, some of the gas is used as fuel for power generation at the UPP™ 9. This is carried out by gas turbine power production unit 15 in which the gas (containing short-chain hydrocarbons, i.e. natural gas) is combusted to generate power. Such electrical power production may be used to meet some, or all, of the power demand at the reservoir.

In a variant of this embodiment, instead of using the gas for re-injection, it is also conditioned at the UPP™ 9, (separately from the oil), such that it is also outside of the hydrate-forming region of an additional long-distance pipeline 10' extending to host 11, along which it is then transported. This further improves the economic sustainability of the reservoir.

The water separated from the hydrocarbon-containing fluid is treated and conditioned at the UPP™ 9 by produced water treatment system 14 to a standard that it can be re-injected into the reservoir to support its pressure. This treated water passes from the UPP™, down through a conduit in riser 8 via riser base 7, flow lines 5 and water injection pumps 13 to water injectors 34.

The separation process is tailored to have specific injection qualities depending on reservoir requirements. The water could be tailored depending on fracking requirements in the reservoir, for pressure support, or treated to an ultrapure quality to meet environmental standards, for example. However, the main requirement is that the treatment allows the produced water to be re-injected into the reservoir via water injection pumps 13.

Some or all water recovered from the hydrocarbon-containing fluid may be treated at the UPP™ 9 to a level that allows it to be released into the sea.

The processing temperature of the liquids (oil/water separation and produced water treatment at the UPP™ 9) is mainly governed by the reservoir temperature, typically ranging from about 20° C. upwards but heat may be added to the liquids for optimal processing temperature.

Figure 2:
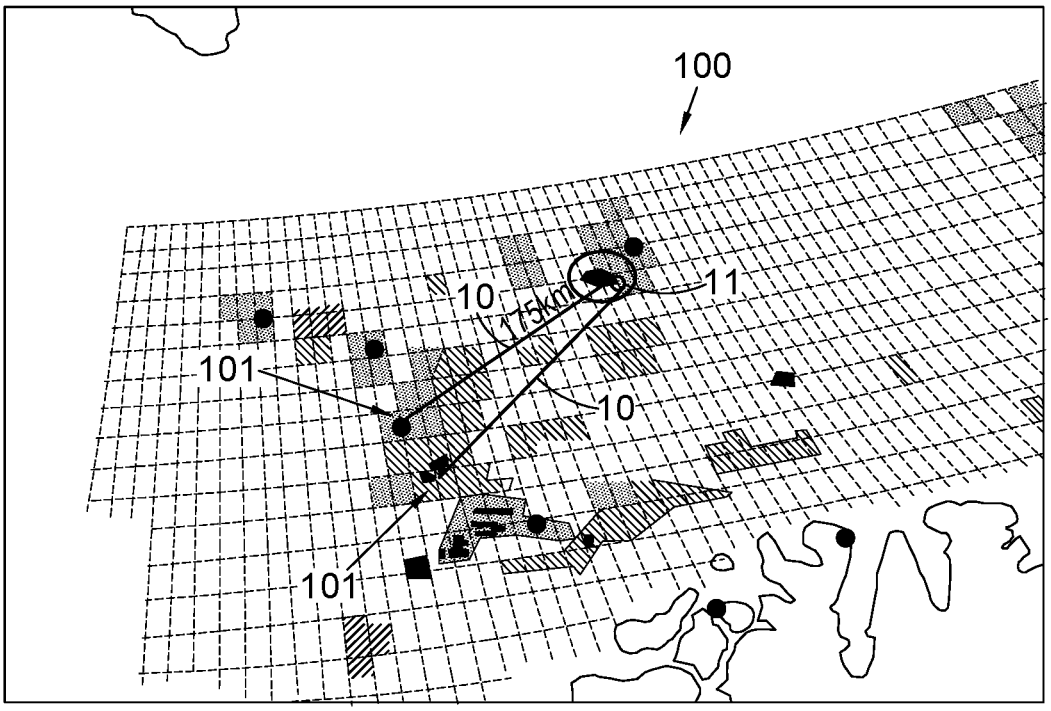
FIG. 2 is an overview of the embodiment of FIG. 1.

The long distances over which the oil product is transported may be seen from FIG. 2, which shows a number of offshore oil production facilities 101 located at marginal fields in the Barents Sea. Each of these offshore oil production facilities 101 corresponds to the local system described above and includes at least one Unmanned Production Platform that is "tied-back" via a long-distance pipeline 10 to a host 11, thereby allowing the transportation of the oil product to the host. In this embodiment an offshore production facility 101 is tied-back 175 km to a host 11.

The flow diagram of FIG. 3 schematically shows the separation and processing features of the local UPP™ 9 in greater detail, along with the subsea components of the embodiment, which have been described already with reference to FIG. 1. Thus, produced fluid from a number of wellheads 1 is boosted through multi-phase pump 6 and then passes through flow lines 5, and riser base 7 and production riser conduit 17 to the UPP™ (which houses the components shown above the central horizontal dividing line). Also shown are certain water injection components, including water injection pumps 13, which are fed with produced water by water injection riser conduit, and water injectors 34. In addition, gas injectors 3 are shown connected to gas injection riser conduit 20.

It should be noted that the production riser conduit 17, produced water riser conduit 18, semi-stable crude oil riser conduit 19 and gas injection riser conduit 20 are all included in the structure of riser 8 (see FIG. 1). They are shown separated in FIG. 3 merely for clarity.

The production riser conduit 17 leads to a first stage, three phase, separator 21 having outlet conduits 23 for gas, 24 for oil and 36 for water. The first is connected to the output from a downstream flash gas compressor, which will be discussed below. The second leads via valve 26 to the input of second stage separator 28. The separators may be gravity separators, cyclone separators or any other separator known in the art. The third outlet conduit leads, via water treatment unit 29 and produced water pump 31, to produced water riser 18.

The second stage separator is two-phase, having outlet conduits 44 for gas and 45 for oil. The former is connected to flash gas compressor 35 which has an outlet conduit 43 which connects to gas outlet conduit 23 from the first stage separator and leads to first interstage gas cooler 36 and then to first stage suction scrubber 37. The latter 45 leads via oil product pump 30 and semi-stable crude oil riser 19 to the long distance pipeline 10 leading to host 11 (see FIG. 1).

First stage suction scrubber 37 has a single outlet conduit 46 leading to first stage gas injection compressor 38. The outlet conduit 47 from this leads via a second interstage gas cooler 39 to a second stage suction scrubber 40 and a second stage gas injection compressor 41 which feeds gas inlet riser conduit 20, which leads to the gas injectors 3 at the sea bed.

The suction scrubbers both also have outlet conduits 47, 48 for oil that has been scrubbed from the gas. The one from the second stage suction scrubber 48 leads back via valve 49 to the first stage scrubber and the one from the first stage scrubber 47 leads back via valve 50 to second stage separator 28.

After the produced fluid has been lifted through the production riser 17 to the UPP™ 9, it enters first stage separator 21. This holds the hydrocarbon-containing fluid at a pressure of approximately 15 bar and partially separates the fluid into three components: primarily consisting of oil, gas, and water respectively in the known manner.

The separated oil is then passed via conduit 24 and valve 26 to second stage separator 28. The separated water is passed through water conduit 25 to water treatment unit 29 and the separated gas is passed through gas conduit 23.

The second stage separator 28 reduces the oil fluid to a pressure of approximately 4 bar, a lower pressure than the first stage separator in order to flash down the oil fluid, thereby releasing gas from within the fluid. This flash gas is separated from the oil fluid such that the oil is conditioned (dewatered and degassed) to a level at which it is semi-stabilised. The level of dewatering and degassing required depends on the conditions that the oil will be held at, particularly when transported via the long-distance oil pipeline 10, and the corresponding hydrate forming envelope for the oil product under these conditions.

Thus, the semi-stabilised oil product passes from the second stage separator 28 in a condition that is outside of the hydrate-forming envelope of the long-distance pipeline 10 to the host 11. Following this, the semi-stabilised oil product is boosted through oil product pump 30, and passed down semi-stable oil product riser 19, after which it is exported to the host along subsea long-distance export lines 10. As the semi-stabilised oil product is outside of the hydrate-forming region, the use of heating, insulation, introduction of hydrate inhibitors and/or pigging is not necessary in the long-distance pipeline 10.

In this embodiment, the flash gas produced in second stage separator 28 (at a pressure of 4 bar) is removed from the second stage separator 28 and recompressed to a pressure of 15 bar (the same pressure as the gas removed from the first stage separator 21) in flash gas compressor 35. The flash gas is then recombined with the gas removed via the first stage separator 21 and passed through a first interstage gas cooler 36 in order to cool the gas and remove the resultant heat from the prior compression. In this embodiment, the cooling in each cooler is carried out via a heat exchanging relationship with seawater and/or air.

The combined gas ("the gas") is then passed through first stage suction scrubber 37 in order to remove particulates and condensates from the gas and protect later gas compressors. This improves the performance of later stage gas compressors and other components.

The gas is then passed through first stage gas injection compressor 38 in order to raise its pressure to 38 bar. The gas is subsequently cooled in second interstage gas cooler 39.

The gas then enters second stage suction scrubber 40 in order to remove any further particulates or condensate before entering a second stage gas injection compressor 41 that raises the pressure of the gas to 100 bar, the final pressure before re-injection into the subsea reservoir.

The gas at 100 bar is then passed down through gas injection riser 20 to gas injectors 3, where it is re-injected into the reservoir to support the reservoir pressure.

The separated water from first stage separator 21 is conditioned at water treatment unit 29 in order to meet the conditions required for re-injection into the subsea oil reserve, as discussed above. This produced water is then pumped through produced water pump 31, and passed down produced water riser conduit 18.

The invention claimed is:

1. A system for hydrocarbon production comprising:
- a host for receiving produced hydrocarbon; and
- a plurality of offshore hydrocarbon production facilities, each being an unmanned production platform comprising:
  - a production wellhead for connection to a subsea hydrocarbon reservoir; and
  - a production platform configured to receive produced fluid from the wellhead and being in fluid communication with the host via a long distance pipeline at least 50 km in length;

wherein the wellhead is local to the production platform, the production platform is configured to process the produced fluid to provide a semi-stable oil product suitable for exporting along the long distance pipeline to the host such that the semi-stable oil product is not fully stabilized but is taken outside of a hydrate envelope for the conditions under which the semi-stable oil product will be held in the long distance pipeline, and the host is configured to further process the semi-stable oil product to a fully stabilized product via separation, degassing and/or dewatering and store the fully stabilized oil product for subsequent transportation or transport the fully stabilized oil product directly to a terminal.

2. The system according to claim 1, wherein the processing of the produced fluid comprises degassing the produced fluid and/or separating water from the produced fluid to an extent that the semi-stabilised fluid is taken outside of the hydrate envelope for the conditions within the long distance pipeline, whereby significant formation of hydrates in the long distance pipeline is avoided.

3. The system according to claim 1, wherein the semi-stable oil product has a true vapour pressure (TVP) of greater than 1 bar and less than the true vapour pressure of the produced fluid from the well.

4. The system according to claim 3, wherein the semi-stable oil product has a true vapour pressure greater than 1.3 bar and less than 400 bar.

5. The system according to claim 3, wherein the semi-stable oil product has a true vapour pressure of greater than 20 bar and less than 60 bar.

6. The system according to claim 3, wherein the semi-stable oil product has a true vapour pressure of greater than 30 bar and less than 40 bar.

7. The system according to claim 1, wherein the production platform is further configured to process the produced fluid to produce a gas product and/or a water product.

8. The system according to claim 7, wherein the production platform is configured to re-inject at least part of the gas product and/or at least part of the water product into the subsea oil reservoir.

9. The system according to claim 1, wherein the production platform is configured to generate electrical power by combusting at least part of the gas product.

10. The system according to claim 1, wherein the production wellhead is arranged to supply produced fluid to the production platform via subsea flow lines, a riser base and a riser.

11. The system according to claim 7, wherein the production platform is arranged to supply water from the water product and/or gas from the gas product to injection wellheads on the seabed via a riser, a riser base and subsea flow lines.

12. The system according to claim 1, wherein the host is an offshore platform or vessel or is located onshore.

13. The system according to claim 1, wherein the host is located at least 100 km or at least 200 km from the offshore hydrocarbon production facility.

14. The system according to claim 1, wherein the semi-stable oil product is stored at the host.

15. The system according to claim 1, wherein the production platform is configured to process the produced fluid to provide the semi-stable oil product that is sufficiently stable to be transported to the host located at least 100 km or at least 200 km distant therefrom via an unheated subsea pipeline, without the use of hydrate inhibitors, whereby formation of significant hydrates in the long distance pipeline is avoided.

16. The system according to claim 1, wherein the production platform comprises a two-stage separation system for producing the semi-stable oil product.

17. The system according to claim 16, wherein an oil product outlet from a second stage of the two-stage separation system is connected to the long distance pipeline via a riser and a riser base at the seabed.

18. The system according to claim 16, wherein a water product outlet from a first stage of the two stage separation system is connected to injection wellheads on the seabed.

19. The system according to claim 16, wherein a first stage and a second stage of the two-stage separation system have gas outlets leading to a plurality of gas compressors arranged in series and wherein a final compressor of the plurality of gas compressors has an outlet for the gas product.

20. A method of hydrocarbon production comprising:

providing a host for receiving produced hydrocarbon, and a plurality of offshore hydrocarbon production facilities, each hydrocarbon production facility being an unmanned production platform comprising:

a production wellhead for connection to a subsea hydrocarbon reservoir; and a production platform local to the production wellhead, configured to receive produced fluid from the wellhead and being in fluid communication with the host via a long distance pipeline at least 50 km in length;

wherein the production platform processes the produced fluid to provide a semi-stable oil product and exports the semi-stable oil product along the long distance pipeline to the host such that the semi-stable oil product is not fully stabilised but is taken outside of a hydrate envelope for the conditions under which the semi-stable oil product will be held in the long distance pipeline, and the host further processes the semi-stable oil product to a fully stabilized product via separation, degassing and/or dewatering and stores the fully stabilized oil product for subsequent transportation or transports the fully stabilized oil product directly to a terminal.

21. The method as claimed in claim 20, comprising, providing, and using a system according to claim 1.

* * * * *